US007969271B2

(12) United States Patent
Lai et al.

(10) Patent No.: US 7,969,271 B2
(45) Date of Patent: Jun. 28, 2011

(54) CURRENT TRANSFORMER

(75) Inventors: Shin-Tzung Lai, Taoyuan Hsien (TW); Kao-Tsai Liao, Taoyuan Hsien (TW); Zhi-Liang Zhang, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 0 days.

(21) Appl. No.: 12/946,151

(22) Filed: Nov. 15, 2010

(65) Prior Publication Data

US 2011/0115596 A1 May 19, 2011

(30) Foreign Application Priority Data

Nov. 17, 2009 (TW) ..... 98139048 A

(51) Int. Cl.
*H01F 27/02* (2006.01)

(52) U.S. Cl. ..... 336/192

(58) Field of Classification Search ..... 336/65, 336/83, 192, 198, 200, 232
See application file for complete search history.

(56) References Cited

U.S. PATENT DOCUMENTS

| | | | | |
|---|---|---|---|---|
| 4,200,853 | A * | 4/1980 | de Jong et al. | 336/192 |
| 5,181,004 | A * | 1/1993 | Johnson | 336/198 |
| 6,072,380 | A * | 6/2000 | Monroe | 336/198 |
| 6,507,261 | B1 * | 1/2003 | Haga et al. | 336/198 |

* cited by examiner

*Primary Examiner* — Tuyen Nguyen
(74) *Attorney, Agent, or Firm* — Kirton & McConkie; Evan R. Witt

(57) ABSTRACT

A current transformer includes a bobbin, a primary winding coil, a conductive pillar, a magnetic core assembly, and a covering member. The bobbin includes a bobbin body and a concave structure. The primary winding coil is wound around the bobbin body. The conductive pillar is partially accommodated within the concave structure. The magnetic core assembly includes a first magnetic core and a second magnetic core. The first magnetic core and the second magnetic core are partially embedded into the channel. The concave structure is partially enclosed by the second magnetic core. The covering member cooperates with the concave structure to shield the conductive pillar. The conductive pillar and the second magnetic core are separated from each other by the covering member, so that a creepage distance between the conductive pillar and the primary winding coil and a creepage distance between the conductive pillar and the magnetic core assembly are increased.

15 Claims, 10 Drawing Sheets

CURRENT TRANSFORMER

FIELD OF THE INVENTION

The present invention relates to a current transformer, and more particularly to a current transformer with an increased creepage distance by using a covering member or an insulating adhesive.

BACKGROUND OF THE INVENTION

Current transformers are essential electronic components for various kinds of electric appliances. Generally, a current transformer is used for measurement of electric currents. When an electric current in a circuit is too high, a current transformer produces a reduced current accurately proportional to the electric current in the circuit.

A conventional current transformer comprises a bobbin, a magnetic core assembly, a primary winding coil and a secondary winding coil. The primary winding coil and the secondary winding coil are separately wound around a winding section of the bobbin. The magnetic core assembly is partially embedded into the winding section of the bobbin. When an electric current flows in the primary winding coil, a magnetic field is produced in the magnetic core assembly and an induced current is generated in the secondary winding coil.

As the demand on the electric conversion efficiency of electronic device is gradually increased, the safety regulations become more stringent. In other words, the electrical safety distance between the primary winding coil and the secondary winding coil and the electrical safety distance between the magnetic core assembly and the secondary winding coil need to be long enough for the current transformer. Since the primary winding coil and the magnetic core assembly of the conventional current transformer are not sufficiently isolated from the secondary winding coil, the electrical safety distance between the primary winding coil and the secondary winding coil and the electrical safety distance between the magnetic core assembly and the secondary winding coil are too short to meet the safety requirement.

Therefore, there is a need of providing an improved current transformer so as to obviate the drawbacks encountered from the prior art.

SUMMARY OF THE INVENTION

It is an object of the present invention to provide a current transformer having increased creepage distances between the primary winding coil and the secondary winding coil and between the magnetic core assembly and the secondary winding coil.

In accordance with an aspect of the present invention, there is provided a current transformer. The current transformer includes a bobbin, a primary winding coil, a conductive pillar, a magnetic core assembly, and a covering member. The bobbin includes a bobbin body and a concave structure. A channel runs through the bobbin body. The concave structure is disposed in the bobbin body. The primary winding coil is wound around the bobbin body. The conductive pillar is partially accommodated within the concave structure. The magnetic core assembly includes a first magnetic core and a second magnetic core. The first magnetic core and the second magnetic core are partially embedded into the channel. The concave structure is partially enclosed by the second magnetic core. The covering member cooperates with the concave structure to shield the conductive pillar. The conductive pillar and the second magnetic core are separated from each other by the covering member, so that a creepage distance between the conductive pillar and the primary winding coil and a creepage distance between the conductive pillar and the magnetic core assembly are increased.

In accordance with another aspect of the present invention, there is provided a current transformer. The current transformer includes a bobbin, a primary winding coil, a conductive pillar, a magnetic core assembly, and an insulating adhesive. The bobbin includes a bobbin body and a concave structure. A channel runs through the bobbin body. The concave structure is disposed in the bobbin body. The primary winding coil is wound around the bobbin body. The conductive pillar is partially accommodated within the concave structure. The magnetic core assembly includes a first magnetic core and a second magnetic core. The first magnetic core and the second magnetic core are partially embedded into the channel. The concave structure is partially enclosed by the second magnetic core. The insulating adhesive is filled into the concave structure to shield the conductive pillar. The conductive pillar and the second magnetic core are separated from each other by the insulating adhesive, so that a creepage distance between the conductive pillar and the primary winding coil and a creepage distance between the conductive pillar and the magnetic core assembly are increased.

The above contents of the present invention will become more readily apparent to those ordinarily skilled in the art after reviewing the following detailed description and accompanying drawings, in which:

DETAILED DESCRIPTION OF THE PREFERRED EMBODIMENT

The present invention will now be described more specifically with reference to the following embodiments. It is to be noted that the following descriptions of preferred embodiments of this invention are presented herein for purpose of illustration and description only. It is not intended to be exhaustive or to be limited to the precise form disclosed.

Figure 1:
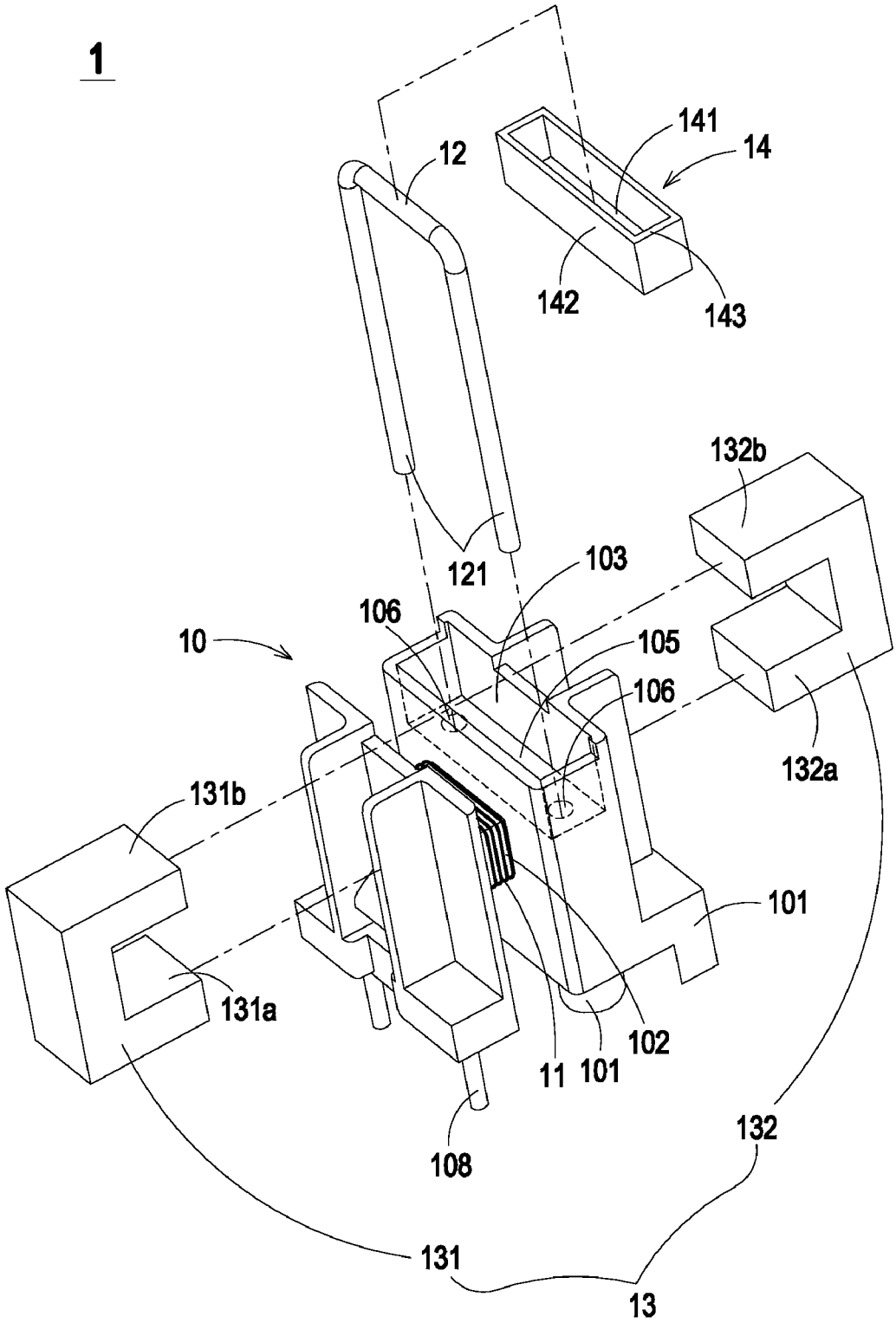
FIG. 1 is a schematic exploded view illustrating a current transformer according to a first embodiment of the present invention.
Figure 2:
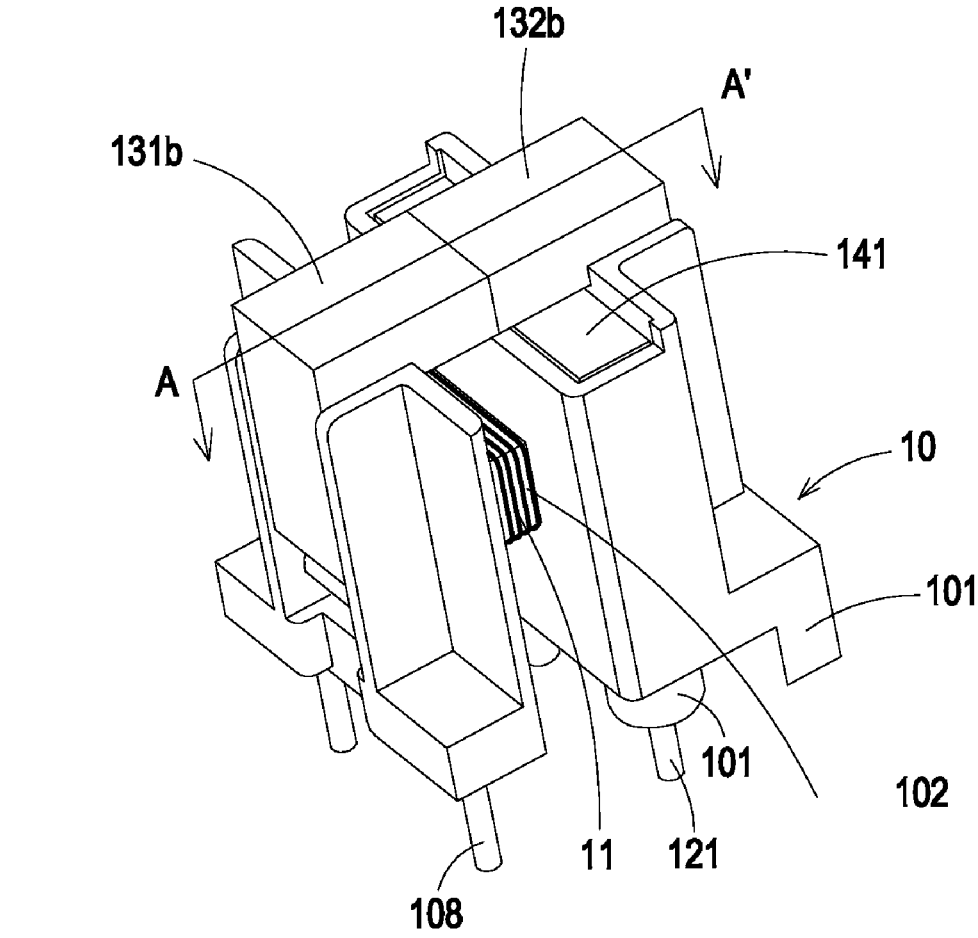
FIG. 2 is a schematic assembled view illustrating the current transformer of FIG. 1.
Figure 3:
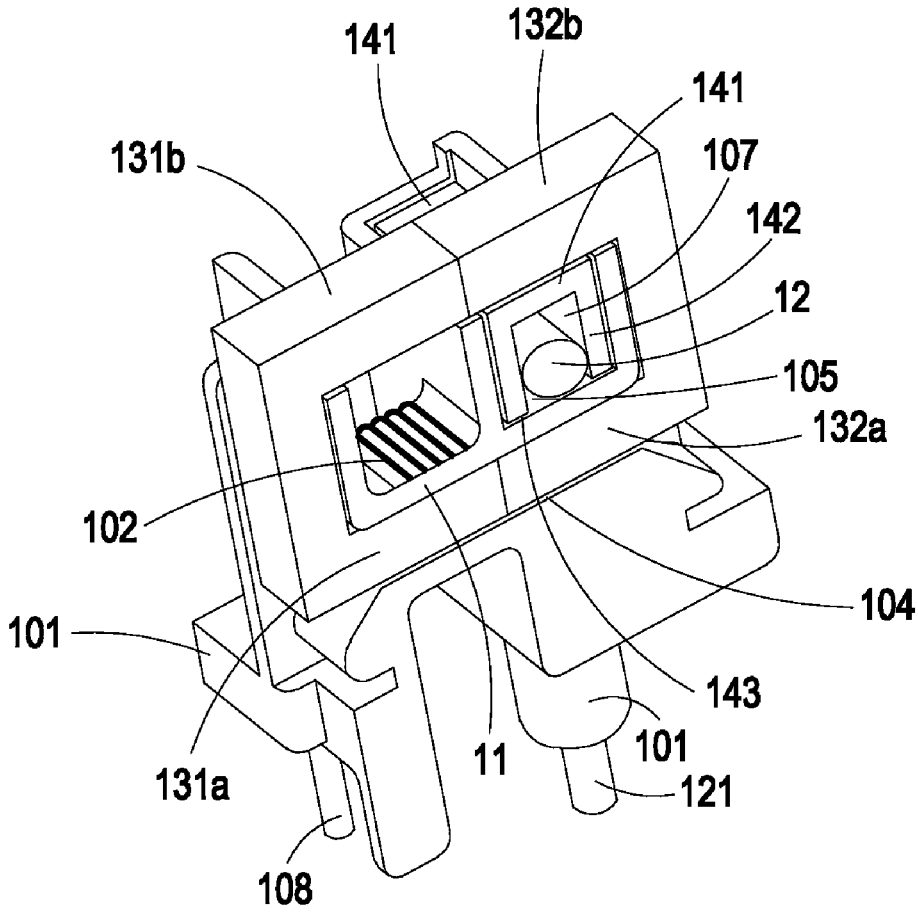
FIG. 3 is a schematic cutaway view illustrating the current transformer of FIG. 2 and taken along the line A-A'.

FIG. 1 is a schematic exploded view illustrating a current transformer according to a first embodiment of the present invention. FIG. 2 is a schematic assembled view illustrating the current transformer of FIG. 1. FIG. 3 is a schematic cutaway view illustrating the current transformer of FIG. 2 and taken along the line A-A'. Please refer to FIGS. 1, 2 and 3. The current transformer 1 comprises a bobbin 10, a primary winding coil 11, a conductive pillar 12, a magnetic core assembly 13 and a covering member 14. The bobbin 10 comprises a bobbin body 101, a winding section 102 and a concave structure 103. The bobbin body 101 has a channel 104. The winding section 102 and the concave structure 103 are separated from each other. In addition, plural perforations 106 are formed in a bottom surface 105 of the concave structure 103.

The primary winding coil 11 is wound around the winding section 102 and served as a primary side. The conductive pillar 12 is accommodated within the concave structure 103, and served as a secondary side. Since the conductive pillar 12 has a large cross-sectional area than a conductive wire, the conductive pillar 12 that is served as the secondary side of the current transformer 1 may withstand a higher output current.

In an embodiment, the conductive pillar 12 is a U-shaped copper piece having two first pins 121. The first pins 121 are vertically extended from both ends of the conductive pillar 12. When the conductive pillar 12 is accommodated within the concave structure 103, the first pins 121 are inserted into corresponding perforations 106 and partially protruded out of the bobbin body 101. As a consequence, the first pins 121 may be inserted into corresponding insertion holes of a system circuit board (not shown) such that the current transformer 1 is mounted on the system circuit board. Moreover, via the first pins 121, the current transformer 1 is electrically connected to the electronic components or trace patterns of the system circuit board.

In this embodiment, the covering member 14 has a hollow portion and is made of an insulating material. The covering member 14 comprises a shielding plate 141 and a sidewall 142. The sidewall 142 is vertically extended from the periphery of the shielding plate 141. When the covering member 14 is accommodated within the concave structure 103, the edge portion 143 of the sidewall 142 is sustained against the bottom surface 105 of the concave structure 103. At the same time, a receptacle 107 is defined by the shielding plate 141 and the sidewall 142 for accommodating and enclosing the conductive pillar 12. In some embodiment, the volume of the covering member 14 is substantially the same as the capacity of the concave structure 103, so that the covering member 14 is tight-fitted into the concave structure 103 and the sidewall 142 of the covering member 14 is sustained against the inner wall of the concave structure 103.

In this embodiment, the magnetic core assembly 13 is a UU10.5 magnetic core assembly. The magnetic core assembly 13 comprises a first magnetic core 131 and a second magnetic core 132. The first magnetic core 131 comprises a first leg portion 131*a* and a second leg portion 131*b*. The first leg portion 131*a* is partially embedded into the channel 104. The winding section 102 and the primary winding coil 11 are partially enclosed by the second leg portion 131*b*. The second magnetic core 132 comprises a third leg portion 132*a* and a fourth leg portion 132*b*. The third leg portion 132*a* is partially embedded into the channel 104. The shielding plate 141 of the covering member 14 and the concave structure 103 are partially enclosed by the fourth leg portion 132*b*. In other words, the shielding plate 141 is arranged between the fourth leg portion 132*b* and the conductive pillar 12.

After the bobbin 10, the primary winding coil 11, the conductive pillar 12, the magnetic core assembly 13 and the covering member 14 are assembled into the current transformer 1 (as FIG. 2), the covering member 14 is accommodated within the concave structure 103, and the edge portion 143 of the sidewall 142 is sustained against the bottom surface 105 of the concave structure 103. At the same time, the shielding plate 141 and the sidewall 142 collectively define the receptacle 107 for accommodating and enclosing the conductive pillar 12. Since the conductive pillar 12 and the fourth leg portion 132*b* of the second magnetic core 132 are separated from each other by the shielding plate 141 of the covering member 14, the creepage distance between the conductive pillar 12 and the fourth leg portion 132*b* is increased by the shielding plate 141. In addition, since the conductive pillar 12 and the primary winding coil 11 are separated from each other by the sidewall 142 of the covering member 14, the creepage distance between the conductive pillar 12 and the primary winding coil 11 is increased by the sidewall 142. That is, the use of the covering member 14 may increase the safety of the current transformer 1.

In some embodiment, the bobbin 10 further comprises plural second pins 108. The second pins 108 may be inserted into corresponding insertion holes of a system circuit board (not shown) such that the current transformer 1 is mounted on the system circuit board. The second pins 108 are made of a conductive material. The outlet parts (not shown) of the primary winding coil 11 are soldered on corresponding second pins 108. Via the second pins 108, the current transformer 1 is electrically connected to the electronic components or trace patterns of the system circuit board.

Figure 4:
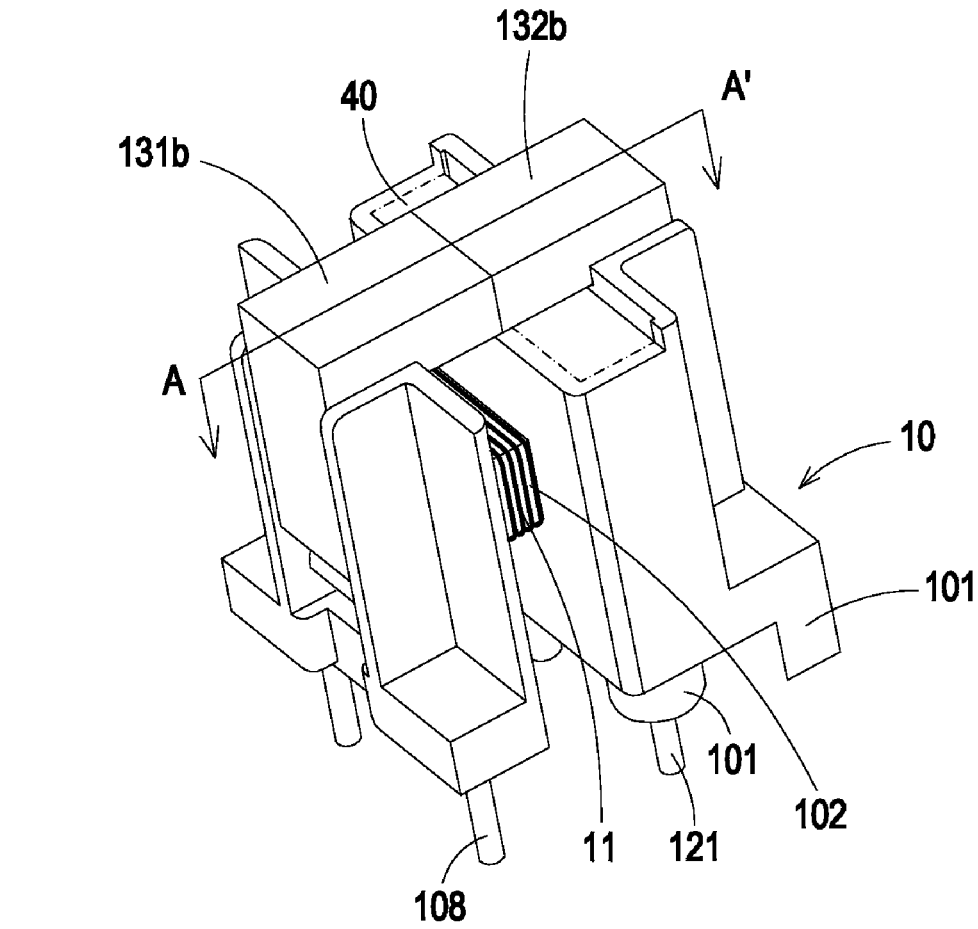
FIG. 4 is a schematic assembled view illustrating a current transformer according to a second embodiment of the present invention.
Figure 5:
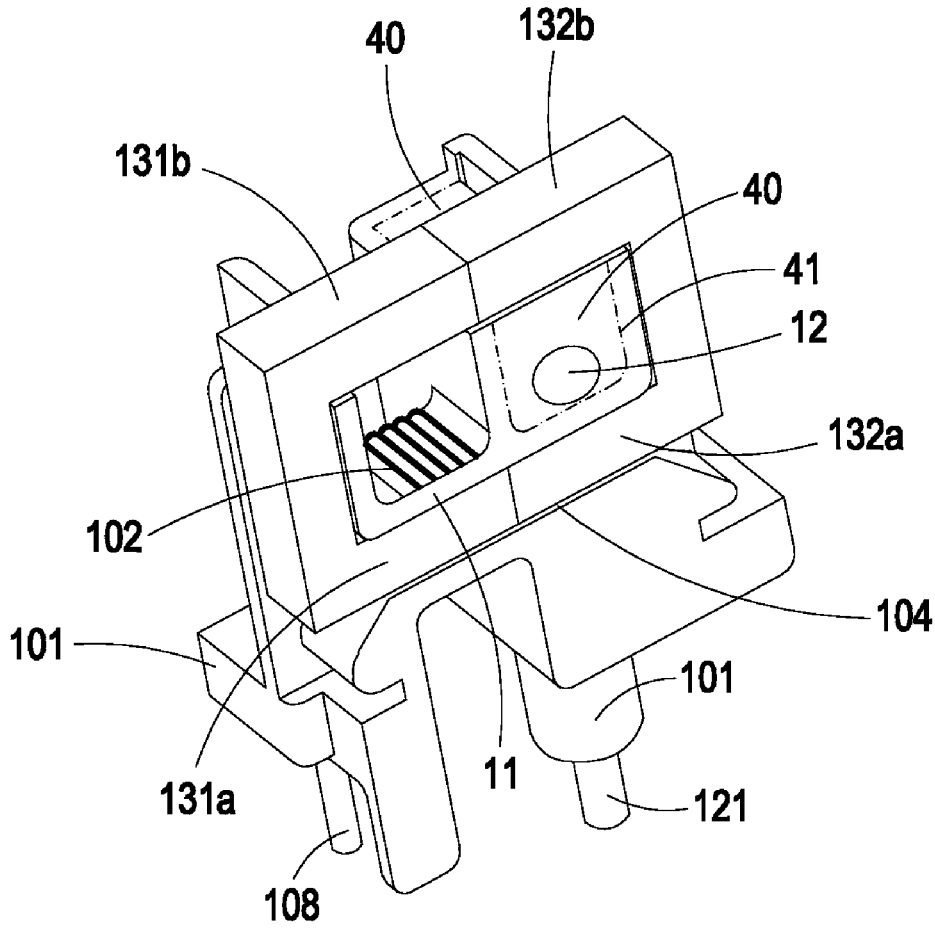
FIG. 5 is a schematic cutaway view illustrating the current transformer of FIG. 4 and taken along the line A-A'.

FIG. 4 is a schematic assembled view illustrating a current transformer according to a second embodiment of the present invention. FIG. 5 is a schematic cutaway view illustrating the current transformer of FIG. 4 and taken along the line A-A'. Please refer to FIGS. 4 and 5. Component parts and elements corresponding to those of the first embodiment are designated by identical numeral references, and detailed description thereof is omitted. In comparison with the first embodiment, the conductive pillar 12 of the current transformer 4 of the second embodiment is not directly inserted into the perforations 106 of the concave structure 103. Whereas, the conductive pillar 12 is integrated into the bobbin 10 by an injection molding process. That is, after the conductive pillar 12 is placed in a molding (not shown), a molten insulating plastic material is injected into the molding to form the bobbin 10, and thus the conductive pillar 12 is integrated into the bobbin 10. In addition, the first pins 121 are partially protruded out of the bobbin body 101.

During the conductive pillar 12 is integrated into the bobbin 10 by the injection molding process, a covering member 40 and a concave structure 41 are simultaneously integrated into the bobbin 10, wherein the covering member 40 is disposed over the conductive pillar 12 and the concave structure 41 is disposed under the conductive pillar 12. After the covering member 40 and the concave structure 41 are integrated into the bobbin 10, the concave structure 41 is sheltered by the covering member 40 and the conductive pillar 12 is enclosed by the covering member 40 and the concave structure 41. Since the conductive pillar 12 and the fourth leg portion 132*b* of the second magnetic core 132 are separated from each other by the covering member 40, the creepage distance between the conductive pillar 12 and the fourth leg portion 132*b* and the creepage distance between the conductive pillar 12 and the primary winding coil 11 are increased. That is, the use of the covering member 40 may increase the safety of the current transformer 4.

Figure 6:
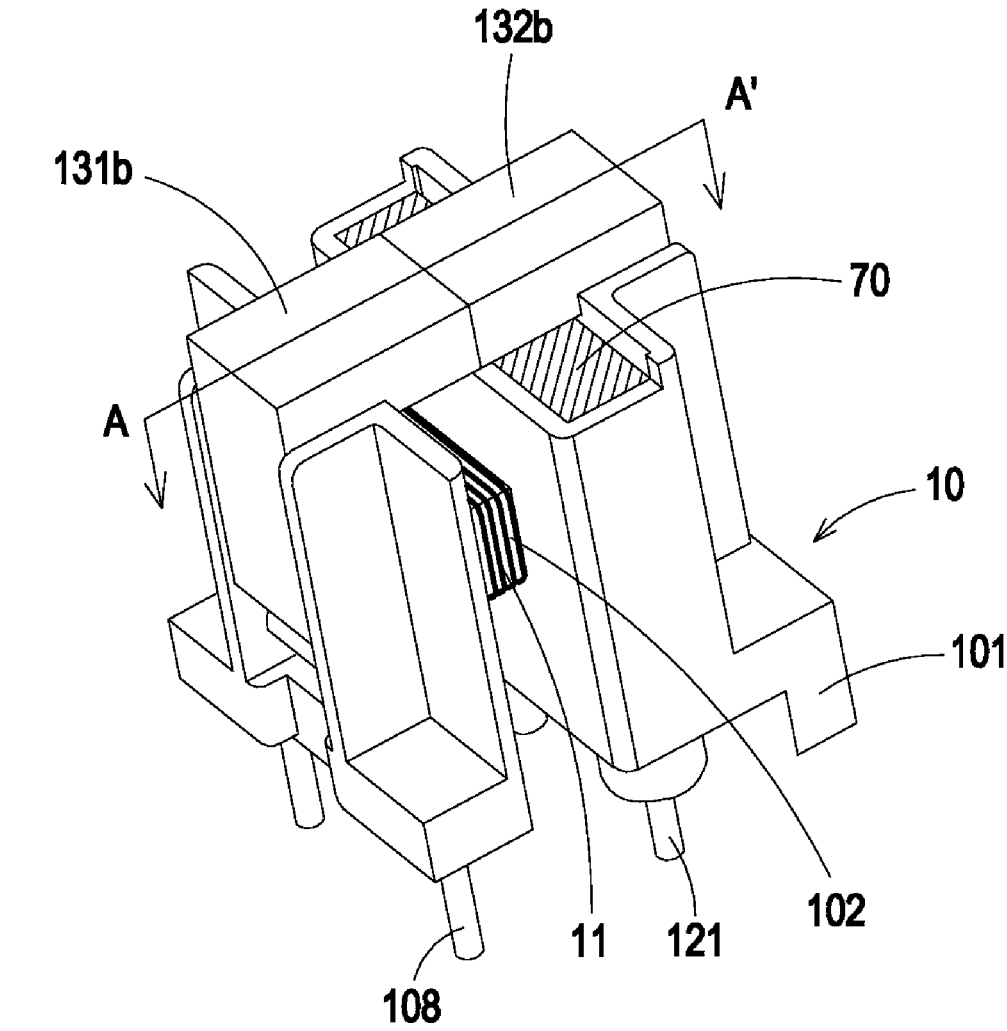
FIG. 6 is a schematic assembled view illustrating a current transformer according to a third embodiment of the present invention.
Figure 7:
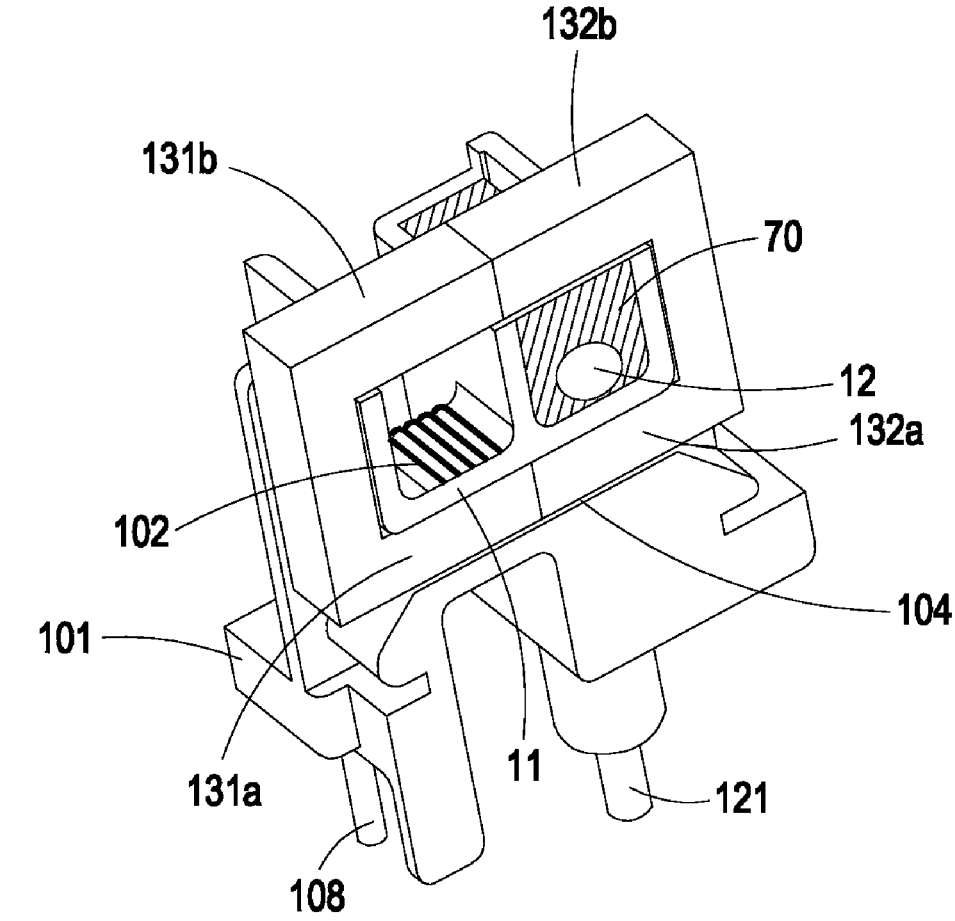
FIG. 7 is a schematic cutaway view illustrating the current transformer of FIG. 6 and taken along the line A-A'.

FIG. 6 is a schematic assembled view illustrating a current transformer according to a third embodiment of the present invention. FIG. 7 is a schematic cutaway view illustrating the current transformer of FIG. 6 and taken along the line A-A'. Please refer to FIGS. 6 and 7. Component parts and elements corresponding to those of the first embodiment are designated by identical numeral references, and detailed description thereof is omitted. In the current transformer 6 of the third embodiment, the covering member 14 used in the first embodiment is replaced by an insulating adhesive 70. After the conductive pillar 12 is accommodated within the concave structure 103, the insulating adhesive 70 is filled into the concave structure 103, so that the conductive pillar 12 is encapsulated by the insulating adhesive 70. Since the conductive pillar 12 and the fourth leg portion 132*b* of the second magnetic core 132 are separated from each other by the insulating adhesive 70, the creepage distance between the conductive pillar 12 and the fourth leg portion 132*b* and the creepage distance between the conductive pillar 12 and the primary winding coil 11 are increased. That is, the use of the insulating adhesive 70 may increase the safety of the current transformer 6.

Figure 8:
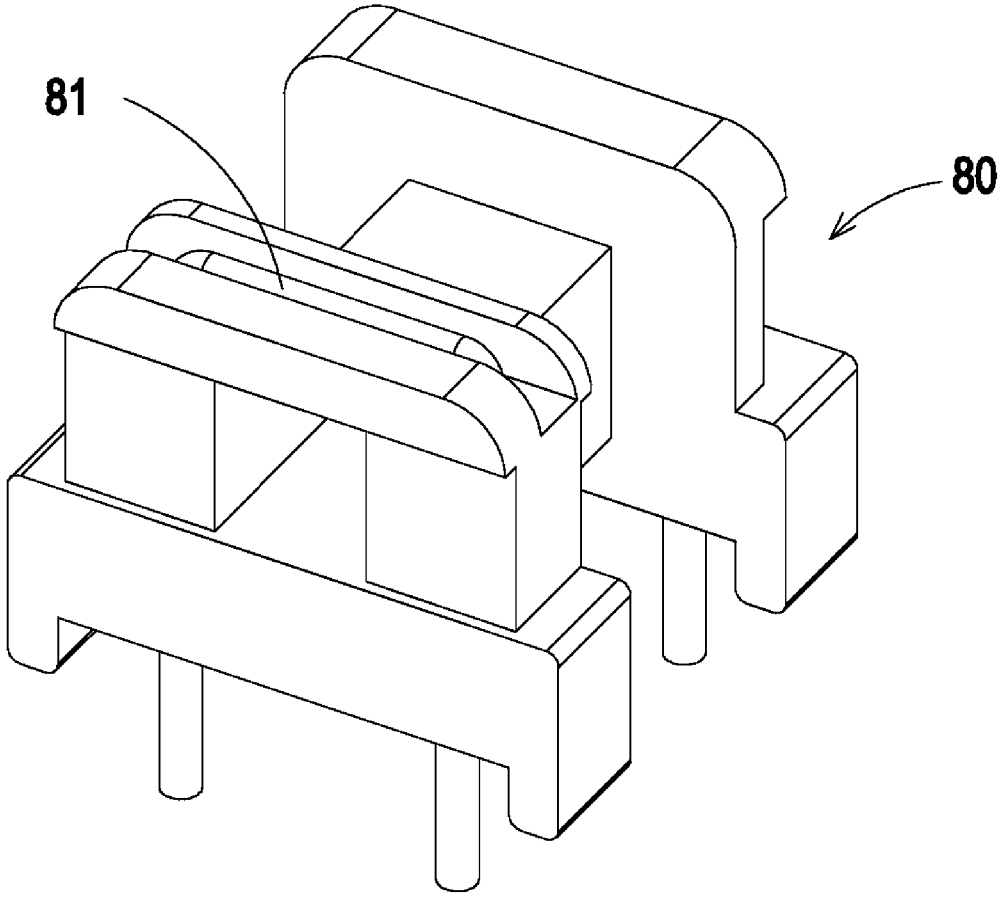
FIGS. 8, 9 and 10 are schematic perspective views illustrating other exemplary bobbins and corresponding conductive pillars.
Figure 9:
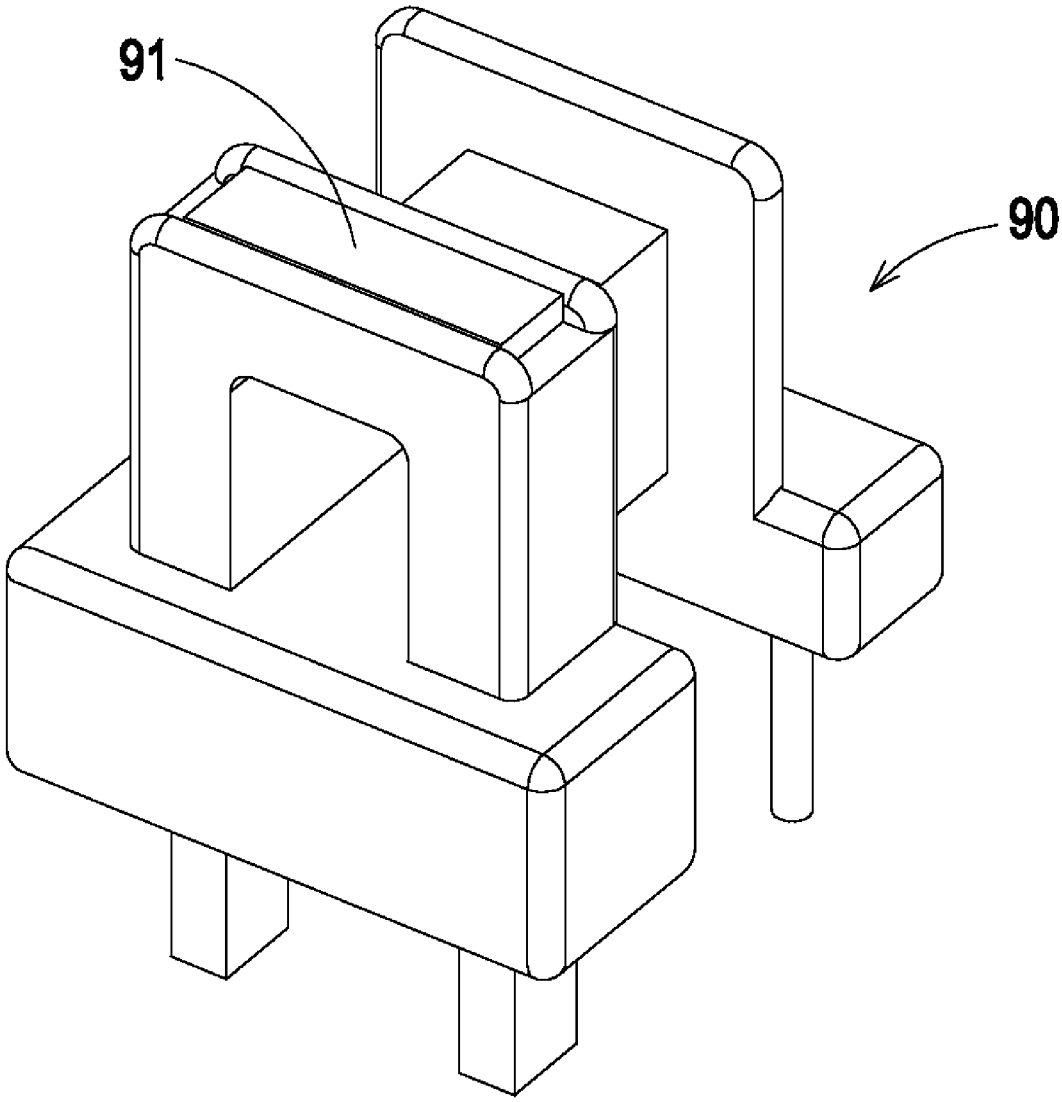
Figure 10:
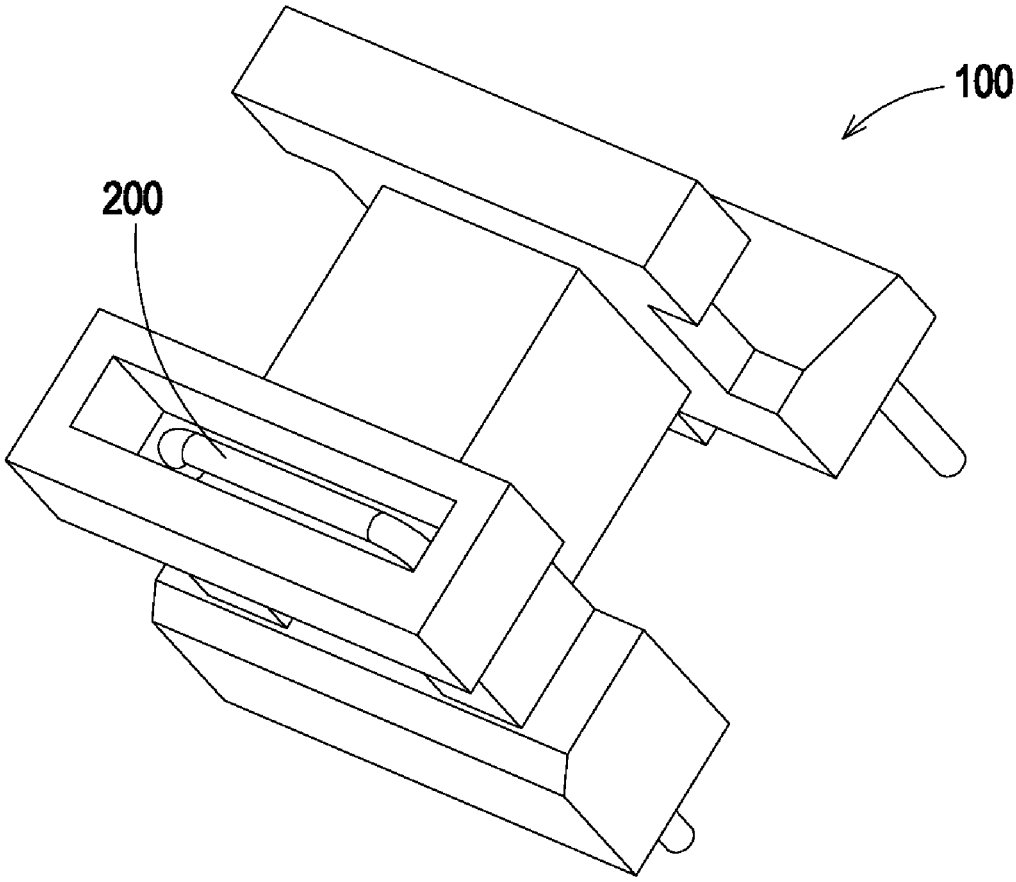

In the above embodiments, the present invention is illustrated by referring to the current transformers having the bobbin 10 as shown in FIGS. 1, 4 and 6. Nevertheless, any other bobbin having a concave structure is feasible as long as a proper conductive pillar is served as the secondary side of the current transformer. FIGS. 8, 9 and 10 are schematic perspective views illustrating other exemplary bobbins and corresponding conductive pillars. The exemplary bobbins and corresponding conductive pillars includes the bobbin 80 and the conductive pillar 81 as shown in FIG. 8, the bobbin 90 and the conductive pillar 91 as shown in FIG. 9, and the bobbin 100 and the conductive pillar 200 as shown in FIG. 10. These bobbins and corresponding conductive pillars may be combined with the covering member 14 of the first embodiment, the covering member 40 of the second embodiment or the insulating adhesive 70 of the third embodiment, thereby assembling a current transformer of the present invention. By means of the covering member 14, the covering member 40 or the insulating adhesive 70, the creepage distance between the conductive pillar and the magnetic core assembly and the creepage distance between the conductive pillar and the primary winding coil are increased.

An exemplary magnetic core assembly cooperating with the bobbin 80 of FIG. 8 includes but is not limited to an EE19 magnetic core assembly. An exemplary magnetic core assembly cooperating with the bobbin 90 of FIG. 9 includes but is not limited to an EE10.2 magnetic core assembly. An exemplary magnetic core assembly cooperating with the bobbin 100 of FIG. 10 includes but is not limited to an EE8.3 magnetic core assembly.

From the above description, since the concave structure is shielded by the covering member or filled with an insulating adhesive, the conductive pillar, the magnetic core assembly and the primary winding coil are separated from each other by the covering member or the insulating adhesive. That is, by means of the covering member or the insulating adhesive, the creepage distance between the conductive pillar and the magnetic core assembly and the creepage distance between the conductive pillar and the primary winding coil are increased. As a consequence, the current transformer of the present invention may meet the safety regulations. Moreover, since the conductive pillar is served as the secondary side of the current transformer, the conductive pillar may withstand a higher output current.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A current transformer comprising:

a bobbin comprising a bobbin body and a concave structure, wherein a channel runs through said bobbin body, and said concave structure is disposed in said bobbin body;

a primary winding coil wound around said bobbin body;

a conductive pillar partially accommodated within said concave structure;

a magnetic core assembly comprising a first magnetic core and a second magnetic core, wherein said first magnetic core and said second magnetic core are partially embedded into said channel, and said concave structure is partially enclosed by said second magnetic core; and a covering member cooperating with said concave structure to shield said conductive pillar, wherein said conductive pillar and said second magnetic core are separated from each other by said covering member, so that a creepage distance between said conductive pillar and said primary winding coil and a creepage distance between said conductive pillar and said magnetic core assembly are increased.

2. The current transformer according to claim 1 wherein said conductive pillar is made of copper.

3. The current transformer according to claim 1 wherein said conductive pillar is U-shaped.

4. The current transformer according to claim 1 wherein said covering member has a hollow portion.

5. The current transformer according to claim 1 wherein said covering member is made of an insulating material.

6. The current transformer according to claim 1 wherein the volume of said covering member is substantially the same as the capacity of said concave structure, so that said covering member is tight-fitted into said concave structure.

7. The current transformer according to claim 1 wherein said first magnetic core comprises a first leg portion and a second leg portion, and said second magnetic core comprises a third leg portion and a fourth leg portion, wherein said first leg portion and said third leg portion are partially embedded into said channel, said primary winding coil is partially enclosed by said second leg portion, and said concave structure is partially enclosed by said fourth leg portion.

8. The current transformer according to claim 7 wherein said covering member comprises a shielding plate and a sidewall vertically extended from a periphery of said shielding plate, wherein said covering member is accommodated within said concave structure, said shielding plate is arranged between said fourth leg portion and said conductive pillar, an edge portion of said sidewall is sustained against a bottom surface of said concave structure, and a receptacle is defined by said shielding plate, said sidewall and said bottom surface of said concave structure.

9. The current transformer according to claim 8 wherein plural perforations are formed in said bottom surface of said concave structure.

10. The current transformer according to claim 9 wherein plural first pins are vertically extended from both ends of said conductive pillar, wherein said first pins are inserted into corresponding perforations and partially protruded out of said bobbin body.

11. The current transformer according to claim 1 wherein said primary winding coil and said conductive pillar are respectively served as a primary side and a secondary side of said current transformer.

12. The current transformer according to claim 1 wherein said conductive pillar is integrated into said bobbin by an injection molding process.

13. The current transformer according to claim 12 wherein said covering member and said concave structure are integrated into said bobbin.

14. The current transformer according to claim 1 wherein said bobbin body further comprises a winding section, and said primary winding coil is wound around said winding section.

15. A current transformer comprising:

a bobbin comprising a bobbin body and a concave structure, wherein a channel runs through said bobbin body, and said concave structure is disposed in said bobbin body;

a primary winding coil wound around said bobbin body;

a conductive pillar partially accommodated within said concave structure;

a magnetic core assembly comprising a first magnetic core and a second magnetic core, wherein said first magnetic core and said second magnetic core are partially embedded into said channel, and said concave structure is partially enclosed by said second magnetic core; and an insulating adhesive filled into said concave structure to shield said conductive pillar, wherein said conductive pillar and said second magnetic core are separated from each other by said insulating adhesive, so that a creepage distance between said conductive pillar and said primary winding coil and a creepage distance between said conductive pillar and said magnetic core assembly are increased.

* * * * *